United States Patent [19]

Kilman et al.

[11] Patent Number: 4,648,416

[45] Date of Patent: Mar. 10, 1987

[54] ARTIFICIAL FINGERNAIL APPLICATOR TOOL

[76] Inventors: Brenda J. Kilman, 420 W. 41st. St., San Bernardino, Calif. 92407; Betty J. Cowart, 751 S. Sycamore, Rialto, Calif. 92376

[21] Appl. No.: 642,577

[22] Filed: Aug. 20, 1984

[51] Int. Cl.[4] ..... A45D 40/26

[52] U.S. Cl. ..... 132/88.7; 132/1 R; 132/73; 132/76.5

[58] Field of Search ..... 128/321, 354; 132/1 R, 132/88.5, 88.7, 73, 73.5, 76.2, 76.4, 76.5; D24/23, 26, 27, 63, 99; D28/55, 56, 57; 81/23, 44

[56] References Cited

U.S. PATENT DOCUMENTS

| | | | |
|---|---|---|---|
| D: 272,479 | 1/1984 | Van Roeyen et al. | D24/27 |
| 1,443,864 | 1/1923 | Blustein et al. | 81/23 |
| 1,667,570 | 4/1928 | Thelander | 132/76.5 |
| 1,695,339 | 12/1928 | Lochhead | 81/23 |
| 1,888,218 | 11/1932 | Bynum | 132/76.5 |
| 1,990,630 | 2/1935 | Bensel | D28/56 |
| 3,478,754 | 11/1969 | Martin, Jr. | 132/1 R |
| 3,561,454 | 2/1971 | O'Connell | 132/1 R |
| 3,703,180 | 11/1972 | Aylott | 132/88.7 |
| 3,906,957 | 9/1975 | Weston | 128/354 |
| 4,222,677 | 9/1980 | Cervantes | 132/88.7 |

FOREIGN PATENT DOCUMENTS

| | | | |
|---|---|---|---|
| 1238944 | 7/1960 | France | 132/88.7 |
| 111558 | 12/1917 | United Kingdom | 81/23 |

*Primary Examiner*—Gene Mancene
*Assistant Examiner*—J. Hakomaki
*Attorney, Agent, or Firm*—Harvey S. Hertz

[57] ABSTRACT

A one-piece tool in the form of an elongated handle having a pocket adjacent one extremity for receiving an artificial fingernail with nominal frictional grip. The handle is then hand gripped and the artificial fingernail, with a quick setting cementing agent applied to its natural fingernail contacting surface, is emplaced in a slot in the handle and held until the tool can be withdrawn leaving the artificial fingernail cemented onto the natural fingernail.

4 Claims, 4 Drawing Figures

ARTIFICIAL FINGERNAIL APPLICATOR TOOL

BACKGROUND OF THE INVENTION

The stylish modern woman frequently regards flawless, elongated fingernails as cosmetically important. Consequently, it has become a well established practice to cement artificial fingernails over the natural fingernails for such a cosmetic purpose The usual artificial fingernail is prefabricated from a semi-rigid plastic material, and is cemented in place over the natural fingernail using a quick-setting cement.

One problem which arises in this art is the handling of the quick setting cement. When the cement is applied, either to the natural fingernail or the cosmetic artificial fingernail, there is an inherent problem of inadvertent misplacement or mishandling of the artificial nail with the result that some of the cement comes into contact with the hands of the artificial nail recipient or those of the operator. This hazard is due to the awkwardness of edge handling the artificial nail in the operator's fingers.

The manner in which the invention deals with the aforementioned disadvantage will be understood as this description proceeds.

SUMMARY

In consideration of the aforementioned problem encountered in manual artificial nail application, the invention comprises a tool in the shape of an elongated handle having an integral slot adjacent its outward extremity for frictionally gripping an artificial fingernail inserted therein. The elongated handle portion extending therefrom is contoured in a smooth curve shape in cross-section for comfortable hand grip by the operator. Preferably also, the elongated handle is bent forward between the hand grip area and the slopped end for improved positioning of the artificial nail as it is being applied.

The details of a typical embodiment of a tool according to the invention will be described hereinafter.

DETAILED DESCRIPTION

Figure 1:
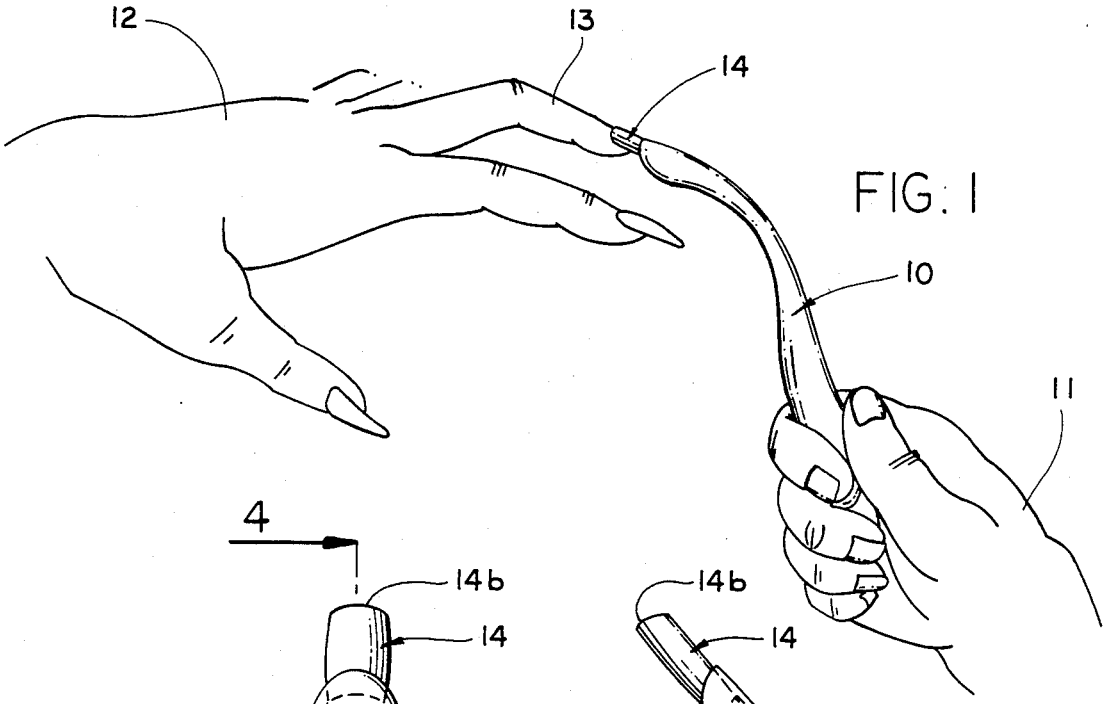
FIG. 1 is a pictorial presentation showing the manner of use of the applicator of the invention.

Referring now to FIG. 1 which is a pictorial view of the tool 10 according to the invention in the hand of an operator 11. An artificial fingernail 14 is being applied over the natural fingernail of finger 13 of recipient's hand 12. The underside of the artificial fingernail 14 which contacts the natural nail is coated with a cementing agent. One of the cyanoacrylate adhesives known in this and other arts is preferred for use as the cementing agent, and in fact, is used in the prior art manual technique for applying the artificial fingernails. Adhesives of that class dry and provide a high degree of adhesion in seconds after application. One commercial product of the type is called "Super Glue" manufactured by Ross Chemical Co., Detroit, Mich. 48209.

The hand of the recipient 12 can be rested on a solid surface (edge of a table, etc.) for stability throughout the process.

Figure 2:
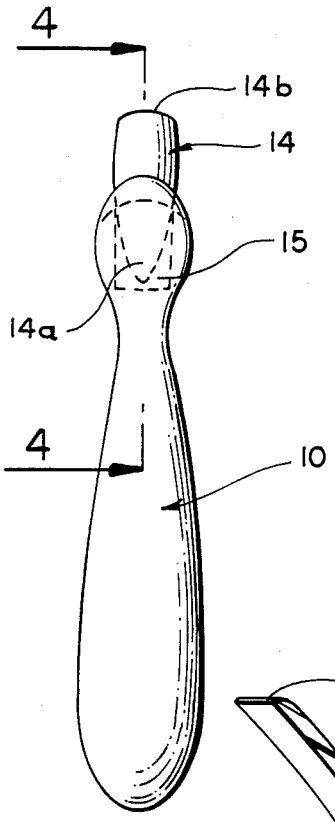
FIG. 2 is a flat projection of the tool of FIG. 1 with an artificial nail inserted therein.
Figure 3:
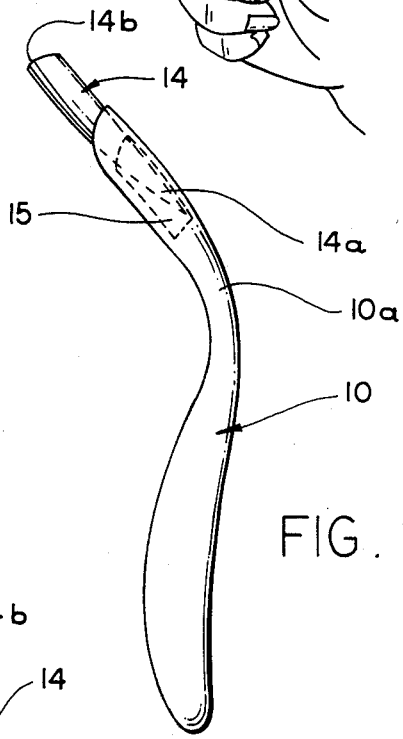
FIG. 3 is a side view of FIG. 2.
Figure 4:
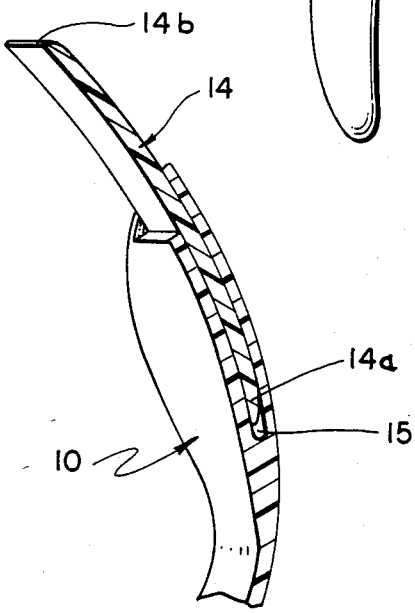
FIG. 4 is a sectional view taken as indicated on FIG. 2, to show the details of the nail-holding pocket.

In FIGS. 2 and 3 top and side views of the typical tool 10 according to the invention are shown. A pocket having a cross-sectional contour approximating that of the artificial fingernail 14 is shown at 15. The artificial nail 14 is inserted with the pointed end 14*a* inward. That end of nail 14 will be the outward extremity of the nail when in place on a recipient's finger, whereas the butt 14*b* of the artificial nail is placed against the cutical of the finger in the conventional manner.

Within a portion 10*a* of the tool 10 handle, there is preferably a forward bend as illustrated in FIGS. 1 and 3. The degree of this bend is not critical, a bend on the order of 20 to 30 degrees being useful.

A suitable material for the tool 10 may be selected from the great variety of commercially available, mouldable, rigid plastic materials. The slot 15 may be moulded according to a conventional process.

Concerning the slot 15, it should be noted that the relatively small degree of frictional hold of the artificial nail 14 in the slot 15 can be provided by the variation of slot curvature in transverse section vis-a-vis the corresponding artificial nail curvature. The semi-rigid material of the conventional nail 14 makes it resiliently deformable when inserted into slot 15 to provide the minimal frictional grip required without the need for close slot tolerances or accurate taper as may otherwise be required.

Of course, the slot 15 could be formed by moulding-in an open-face slot into handle 10 adjacent the extremity as illustrated, and then attaching a closure piece thereover. That alternative is less attractive than the one-piece moulding process presumed hereinbefore as it would be more expensive to manufacture.

The flat projection shape of the tool 10 shown in FIG. 2 presumes a reduced cross-section in the vicinity of the bend at 10*a* (FIG. 3), this shape being convenient, economical of material and less cumbersome in use than would otherwise be the case. The preferable application of the cementing agent is to the surface of the artificial nail, this being the usual practice in the prior art (entirely manual) procedure.

Another approach to providing the necessary frictional grip between the artificial fingernail and the inside surfaces of the pocket (slot)15 is to provide decreasing narrow cross-sectional dimension of the pocket as a function of depth (draft).

Various modifications on the specific embodiment illustrated will suggest themselves to those of skill in this and the related arts. Accordingly, it is not intended that the scope of the invention should be considered limited to the specific illustrations or to this description.

Since the cementing agent reaches a high degree of strength very quickly, it is only necessary to hold the position depicted in FIG. 1 for a fraction of a minute. An operator's finger or thumb may apply normal pressure to the artificial nail as the tool 10 is withdrawn to avoid unnecessary stressing of the bond between artificial and natural nail surfaces.

We claim:

1. An artifical fingernail applicator, comprising: a one-piece elongated handle of rigid material including an operator hand grip, said handle extending beyond said hand grip portion to an extremity;

means defining a pocket within said handle adjacent said extremity, said pocket being formed to open axially outward for receiving the outward end of an artificial fingernail, said pocket further being shaped to elastically deform said fingernail within the area inserted into said pocket to produce a frictional grip between said pocket and said artificial fingernail.

2. The applicator according to claim 1 in which said pocket shape for elastically deforming said artificial fingernail is substantially arcuate in the transverse plane, said arcuate pocket shape having a curvature differing by a predetermined amount as compared to the arc of the transverse cross-section of said artificial fingernail.

3. The applicator according to claim 1 in which said handle is bent forward toward the hand of the recipient by an angle not exceeding thirty degrees.

4. The applicator according to claim 2 in which said handle is bent forward toward the hand of the recipient by an angle not exceeding thirty degrees.

* * * * *